United States Patent [19]

Shibamoto

[11] 4,196,534

[45] Apr. 8, 1980

[54] PLASTIC NET BAG AND LABEL

[76] Inventor: Toshitsune Shibamoto, 122, Ena, Wakayama City, Wakayama Prefecture, Japan

[21] Appl. No.: 845,923

[22] Filed: Oct. 27, 1977

[51] Int. Cl.[2] ..... G09F 3/18

[52] U.S. Cl. ..... 40/10 R; 150/1; 40/2 R

[58] Field of Search ..... 40/2, 2.3, 615, 20, 40/10; 150/1, 1.7; 229/53

[56] References Cited

U.S. PATENT DOCUMENTS

| | | | |
|---|---|---|---|
| 1,798,493 | 3/1931 | Porges | 40/2 R |
| 2,835,621 | 5/1958 | Braun et al. | 40/2 R X |
| 3,224,123 | 12/1965 | Templeton | 40/2 R |
| 3,483,907 | 12/1969 | Corridon | 150/1.7 |
| 3,595,739 | 7/1971 | Meyer | 40/2 E X |

FOREIGN PATENT DOCUMENTS

| | | | |
|---|---|---|---|
| 1208680 | 4/1962 | Fed. Rep. of Germany | 150/1 |
| 776789 | 6/1957 | United Kingdom | 40/2.2 |

*Primary Examiner*—Louis G. Mancene
*Assistant Examiner*—Wenceslao J. Contreras
*Attorney, Agent, or Firm*—Eric P. Schellin

[57] ABSTRACT

A bag including a bag body of net fabric formed by circular knitting from thermoplastic resin monofilament yarns, and a label of thermoplastic resin film affixed to the outer side of the bag body by heat and pressure at specified areas. The label is thermally adhered to the bag body by melting substantially the entire thickness thereof, and partially melting the monofilament yarns on the outer side of the bag body facing the label. The label is thus adhered to the bag with a high degree of stability, thereby assuring that it will not separate from the monofilament yarns. Preferably, the bag body is made from a circular knit fabric in which the number of crosswise yarns is smaller than the number of lengthwise yarns to provide a reduced number of courses per unit length of the fabric, thereby rendering the bag more stretchable crosswise than lengthwise, and which further contains a single or plurality of straight monofilament yarns extending crosswise ever several courses so that the lengthwise and crosswise stretch of the bag can be minimized when the bag contains vegetables, such as onions. A method of making the bag is also disclosed.

2 Claims, 7 Drawing Figures

PLASTIC NET BAG AND LABEL

BACKGROUND OF THE INVENTION

This invention relates to bags having a label affixed thereto for containing vegetables and a method of making the same, and more particularly, to bags made from a tubular net fabric formed by circular knitting and having a label affixed thereto for containing vegetables.

In recent years, bags made of tubular net fabrics formed on a circular knitting machine from polyolefin or like resin monofilament yarns have found wide use for containing onions and other vegetables. The bags are made of tough and durable yarns which can be efficiently manufactured on circular knitting machines. Bags of this type have had wide acceptance in that they are convenient to use because the knitted net fabric forming the bags have good ventilating properties and permit the user to see the contents. Generally, labels bearing a printed trademark or the like are affixed to such bags usually by a molten resin which serves as an adhesive when applied to substantially the entire area of the label in the form of many lines. Thus the adhering procedure is very cumbersome and costly because the molten resin must be used in such a large quantity as to fill up the stitches of the net fabric and cover the knitted yarns.

Bags are also made by sewing a folded piece of plain stitch net fabric into the form of a bag. Labels may be attached to such bags by fitting the label around the bag and sewing the opposite ends of the label to the side edge of the seam of the bag. However, the label is not retainable in place and is liable to separate from the bag. Additionally, the bags which differ in construction from those of the foregoing type are troublesome and costly to make.

Especially, it has been considered impossible to thermally adhere a label of synthetic resin film to a bag made of net fabric of monofilament yarns as in film-to-film adhesion, because the monofilament yarns are liable to break when the bag of net fabric is heated under pressure.

At present, bags formed of a circular knit net fabric are stretchable both lengthwise and crosswise, and fail to retain their shape when filled with onions and like vegetables. When labels are affixed to the net fabric, such deformation produces a serious affect on the labels causing them to separate. It has heretofore been attempted to restrict the lengthwise and crosswise stretch of the bag with the use of a knitted fabric of specific structure or by fixing the stitches of the fabric, but fully satisfactory results still remain to be achieved.

SUMMARY OF THE INVENTION

An object of this invention is to provide a bag body of net fabric formed by circular knitting from monofilament yarns and adhering a label of synthetic resin film thermally to the bag body without completely melting the monofilament yarns of the bag body.

A further object of this invention is to provide a bag body where the label is adhered to the bag body with a high degree of stability, free of rupture and without entailing any breaking or melting of the monofilament yarns at the adhered areas.

Another object of this invention is to provide a bag having a structure in which the bag is more stretchable crosswise then lengthwise and which includes a monofilament yarn extending straight crosswise every several courses to restrict the greater crosswise stretch of the bag, minimizing lengthwise and crosswise stretch thereby retaining its shape and rendering the label thereon more resistant to separation during use.

These and other objects of this invention will become more apparent from the following description given with reference to the accompanying drawings.

DESCRIPTION OF THE PREFERRED EMBODIMENTS

Figure 1:
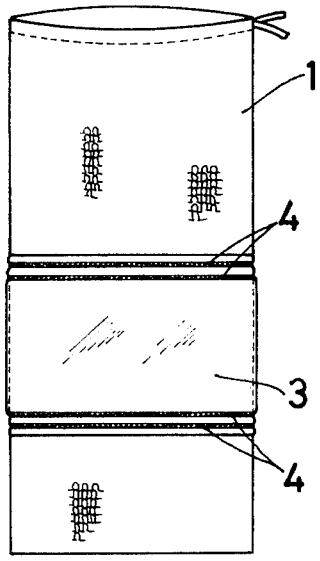
FIG. 1 is a front view of the invention showing an embodiment of this invention.
Figure 2:
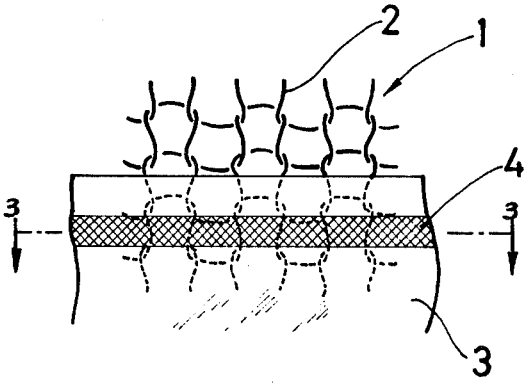
FIG. 2 is an enlarged fragmentary view of FIG. 1.
Figure 3:
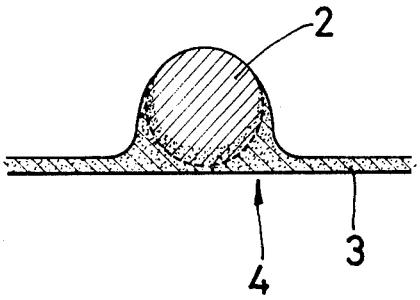
FIG. 3 is an enlarged view in section taken along the line 3—3 in FIG. 2.
Figure 4:
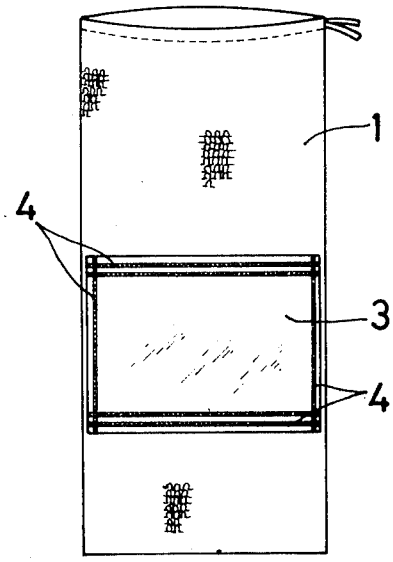
FIG. 4 is a front view of the invention showing another embodiment.

FIGS. 1 to 3 show a bag body 1 of net fabric formed by circular knitting from polyethylene or like thermoplastic resin monofilament yarns 2 and a tubular label 3 made of a film of the same thermoplastic resin as the bag body 1 and bearing such indicia as the place of production, trademark, etc., printed on its surface. The label 3 has a slightly larger crosswise width than the bag body 1. The tubular label 3 is affixed to the bag body 1 by fitting the label around the front and rear sides of the net fabric of the bag body 1 and heating the label 3 from the outside with the application of pressure at its upper and lower marginal portions in the pattern of several stripes 4 using a heated bar, die or roller to thereby leave the indicia on the label in tact. The heating operation melts the label 3 substantially to its entire thickness while partially melting the monofilament yarns 2 of the bag body 1 only on the surface thereof facing the label 3, with the result that the molten resin of the label 3 covering the monofilament yarns 2, as seen in FIG. 3, is integrally joined with the molten portions of the yarns 2.

To achieve the thermal adhesion, the heating temperature and time must be determined in accordance with the kind of thermoplastic resin, denier number of the monofilament yarns, thickness of the label, etc., because if the heating is conducted at a higher temperature or for a longer period of time than is required, the monofilament yarns 2 will be completely melted, whereas in sufficient adhesion will result if the heating temperature is too low or the heating time is too short. For example, when the bag body 1 is formed of 320 to 380 denier polyethylene monofilament yarns 2, the proper heating temperatures and times are as listed below:

| Thickness of Label (mm) | Heating Time (seconds) | Heating Temperature (° C.) |
|---|---|---|
| 0.1 | 4 | 150–160 |
| 0.1 | 2 | About 190 |

Preferably, the label 3 has a thickness of 0.06 to 0.1 mm, but films of other thicknesses are also usable. In any case, the heating time and temperature must be determined in accordance with the thickness of the label. The heating die or roller should be coated with Teflon, or a release sheet should be provided between the label and the die or roller.

Although the label 3 of the preferred embodiment of this invention is in the form of a tube conforming to the shape of the bag body 1, the labels 3 can be in the form of a sheet of approximately the same width as the bag body 1 and can be affixed to the front and rear sides of the bag 1 by being thermally adhered thereto in the same manner as above. In this case, it is preferable to adhere the labels 3 to the bag body 1 along the opposite side margins as well as at the upper and lower margins.

According to this invention, a label 3 of thermoplastic resin is melted substantially to the entire thickness thereof and adhered to a bag body 1 of net fabric formed of thermoplastic resin monofilament yarns which are partly melted on the side of the bag body facing the label. Consequently, the molten resin of the label 3 covering the monofilament yarns 2 which will predominantly remain unmelted is integrally joined with the molten surface portions of the monofilament yarns 2, thereby forming a tough and reliable joint notwithstanding that one of the adherends is a net fabric. Although partially adhered to the bag body 1, the label 3 can be affixed to the bag body with high stability free of any tendency to separate. Moreover, the monofilament yarns 2, which will not be completely melted, retain their strength without being deformed to a flat shape at the adhered portions. As a result, neither the monofilament yarns nor the label is prone to rupture at the joint. Thus, the knitted bag fully retains its inherent durability and other properties.

The thermal adhesion of the label 3 does not require the use of additional resin serving as an adhesive but merely necessitates a simple procedure of heating with the application of pressure. Since the monofilament yarns are not completely melted, the bag body 1 can be subjected to the thermal adhesion treatment with the front and rear sides of the net fabric in a superposed state and yet remains free of any fabric-to-fabric adhesion between the two sides. Accordingly, there is no need to interpose an intermediate material between the front and rear sides of the net fabric. Moreover, the bag body 1 can be subjected to the adhering treatment from above and below at the same time. These advantages contribute greatly to the efficiency of the label adhering procedure.

Figure 5:
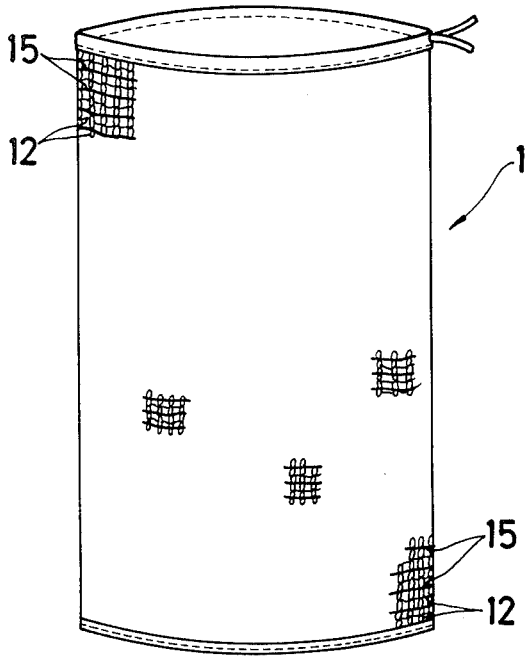
FIG. 5 is a front view of the invention showing a modification of the knitted bag to be used in this invention.
Figure 6:
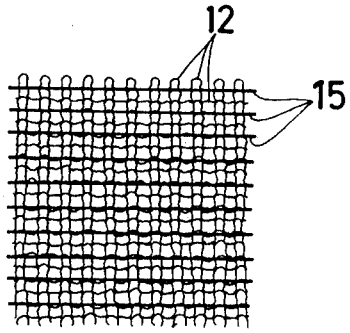
FIG. 6 is a fragmentary plan view on an enlarged scale showing the fabric forming the bag of FIG. 5.
Figure 7:
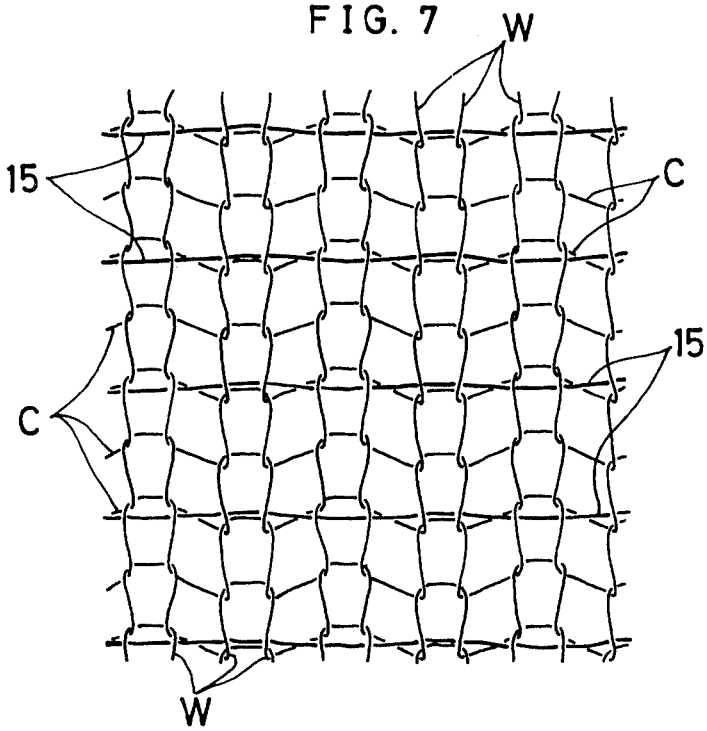
FIG. 7 is an enlarged view showing the fabric of FIG. 6.

FIGS. 5 to 7 show a modification of the bag body 1 of net fabric to be used in this invention. A tubular bag 1 made by circular knitting from polyolefin or like resin monofilament yarns 12, has a bottom formed by folding over the lower end of the fabric and sewing up the fold and a top end opening provided with a draw string for closing the bag. The net fabric forming the bag 1, knitted from the monofilament yarns 12, characterized in that the number of the crosswise yarns is 10 to 30% less than the number of the lengthwise yarns per square inch to provide a reduced number of courses per unit length of the fabric to thereby minimize the lengthwise stretch of the fabric while rendering the fabric more stretchable crosswise, and where the crosswise stretch is restricted by a straight monofilament yarn 15 provided every several courses.

Stated more specifically, a bag 80 cm in length and 40 cm in width was formed on a latch needle circular frame 11 inches in diameter and equipped with 218 needles, using 350 denier polyolefin monofilament yarns on all the needles, such that the fabric had about 14 lengthwise yarns W and 11 crosswise yarns C per square inch. Each of the courses had a width of about 2 mm, and a straight monofilament yarn 15 of polyolefin, 350 denier, was inserted every two courses.

The bag 1 made from the knitted fabric includes about 20% less yarns crosswise than lengthwise to make the bag less stretchable lengthwise than crosswise. By incorporating crosswise straight yarns 15 of the same length as the width of the bag into the fabric, the crosswise stretch of stitches is completely eliminated even when the bag 1 contains 20 kg of onions. Thus, the straight yarns 15 hold the spacing between the stitches constant against stretching crosswise, thereby keeping the width of the bag 1 approximately uniform. The bag 1 has up to one half the stretchability of conventional bags and weighs about 10% less than the conventional bags.

The above embodiment includes 14 lengthwise yarns and 11 crosswise yarns per square inch. Good results, comparable to the above, were achievable when the ratio of the lengthwise yarns to the crosswise yarns in number was in the range of from 14:10 (the latter being 25% less) to 14:12 (15% less). However, when the ratio of the lengthwise yarns to the crosswise yarns, in number, was 14:13, namely, when the lengthwise yarns were approximately equal to the crosswise yarns, in number, the bag was not satisfactory for containing 20 kg of onions, because the bag stretched lengthwise about 10% although the crosswise stretch was prevented by straight yarns provided at a spacing of 4 mm.

When the ratio of the lengthwise yarns to the crosswise yarns, in number, was 14:9 (35% less) with straight yarns inserted at a spacing of 5 mm, the fabric stretched greatly crosswise and, moreover, the greater spacing of the straight yarns prevented them from fully supporting the stitches or acting effectively lengthwise. Thus, the bag stretched markedly both lengthwise and crosswise.

According to this invention, the most economical bags are obtained which are fully prevented from lengthwise and crosswise stretching when they are made from a fabric such as polyolefin or like resin monofilament yarns and in which the number of crosswise yarns is 10 to 30% less than the number of lengthwise yarns, and the fabric further incorporates the same straight yarns 15, as above, which extend crosswise therethrough and are arranged at a spacing of about 4 mm.

The bags of this invention involve greatly reduced lengthwise stretch and little or no crosswise stretch due to the provision of the straight yarn arranged every several courses and which acts to restrain the stitches from stretching crosswise more than its length. The straight yarns which extend across the wales are also effective in restricting the lengthwise stretch of the bag. The bags therefore retain their shape during use and are very convenient to handle and transport.

I claim:

1. A tubular net bag having a label affixed thereto comprising:

a. a bag body of tubular net fabric formed by circular knitting a plurality of thermoplastic resin monofilament yarns having a smaller number of crosswise yarns than the number of lengthwise yarns to provide a greater crosswise stretchability to said bag compared to lengthwise stretchability, b. at least one straight thermoplastic resin monofilament yarn in said tubular net fabric extending crosswise therethrough said tubular net fabric every several courses to limit crosswise stretching of said bag; and c. a thermoplastic film indicia means integrally affixed with said bag body.

2. A tubular net bag as claimed in claim 1 wherein said tubular net fabric having between 10 to 30 percent less crosswise yarns in number to the lengthwise yarns, and said straight thermoplastic resin filament yarns extending crosswise in said tubular net fabric being spaced about 4 millimeters apart.

* * * * *